US007232049B2

(12) United States Patent
Meyer

(10) Patent No.: US 7,232,049 B2
(45) Date of Patent: Jun. 19, 2007

(54) RIGID HIP SUPPORT MEMBER FOR PACKS, BAGS AND OTHER ARTICLES

(75) Inventor: Dean E. Meyer, Oakbrook, IL (US)

(73) Assignee: Meyer Design Group, Inc., Oakbrook, IL (US)

( * ) Notice: Subject to any disclaimer, the term of this patent is extended or adjusted under 35 U.S.C. 154(b) by 109 days.

(21) Appl. No.: 10/610,058

(22) Filed: Jun. 30, 2003

(65) Prior Publication Data

US 2004/0262354 A1 Dec. 30, 2004

(51) Int. Cl.
*A45F 3/04* (2006.01)

(52) U.S. Cl. ..... 224/637; 224/628; 224/634; 206/315.3

(58) Field of Classification Search ..... 224/625, 224/634, 637, 640, 641, 662, 664, 665, 671, 224/677, 628, 630, 262; 206/315.3
See application file for complete search history.

(56) References Cited

U.S. PATENT DOCUMENTS

| | | | | |
|---|---|---|---|---|
| 3,831,827 | A * | 8/1974 | Olson | 224/262 |
| 4,154,381 | A * | 5/1979 | Zufich | 224/262 |
| 4,194,656 | A * | 3/1980 | Zufich | 224/631 |
| 4,214,685 | A * | 7/1980 | Pletz | 224/634 |
| 4,303,186 | A * | 12/1981 | Ollinger, IV | 224/634 |
| 4,361,259 | A | 11/1982 | Chanter | |
| 4,479,595 | A | 10/1984 | Opsal | |
| 4,685,601 | A | 8/1987 | Riddling | |
| 5,419,473 | A * | 5/1995 | Lamar | 224/632 |
| 5,487,498 | A | 1/1996 | Gleason | |
| 5,820,141 | A | 10/1998 | Wilkerson et al. | |
| 5,878,928 | A * | 3/1999 | Seiber | 224/153 |
| 5,950,889 | A * | 9/1999 | Feldman, Jr. | 224/259 |
| 5,996,871 | A | 12/1999 | Maeng | |
| 6,182,874 | B1 | 2/2001 | Feldman, Jr. | |
| 6,199,732 | B1 * | 3/2001 | Swetish | 224/262 |
| 6,536,641 | B1 * | 3/2003 | Sundara et al. | 224/637 |
| 6,840,419 | B2 * | 1/2005 | Penny et al. | 224/637 |

* cited by examiner

*Primary Examiner*—Nathan J. Newhouse
*Assistant Examiner*—Justin M. Larson
(74) *Attorney, Agent, or Firm*—Daniel J. Deneufbourg, Esq.

(57) ABSTRACT

A hip support member for packs, bags and other articles including a pair of spaced-apart rigid arms adapted to engage the hips of the wearer of the pack, bag or article. A sleeve or shoulder associated with either the arms or the article secures the arms to the article. In one embodiment, the arms, shoulders and sleeve combine to define a generally U-shape frame adapted to be mounted to an article and wrap around the hips of the wearer. In another embodiment, the shoulders and/or sleeve are adjustable to adjust the width between the arms and the arms are rotatable about the article between disengaged and engaged positions.

9 Claims, 9 Drawing Sheets

100
102
106
108
110
112
114
116
118
120
122
124
126
128
130
132
134
136
138
140
142
144
146
148
150
152
154
156
158
160

Fig. 10
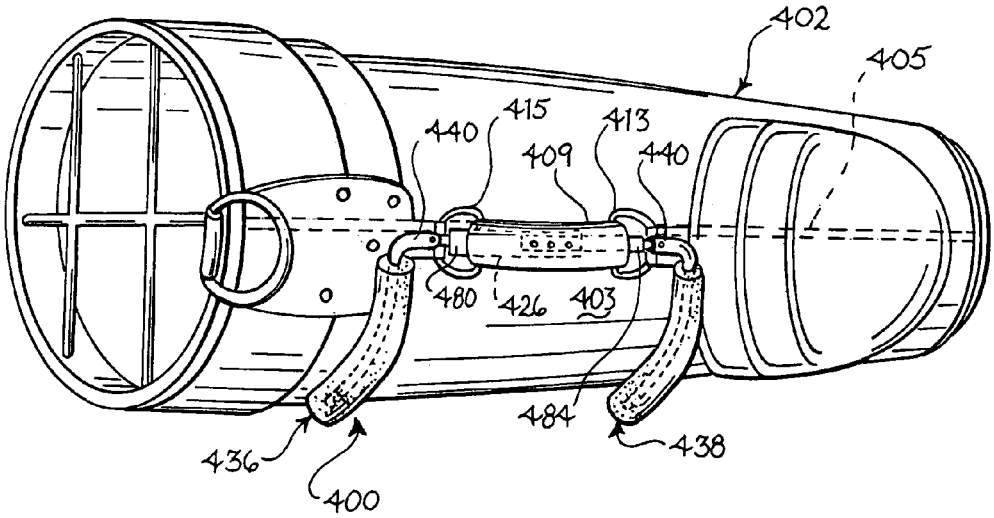
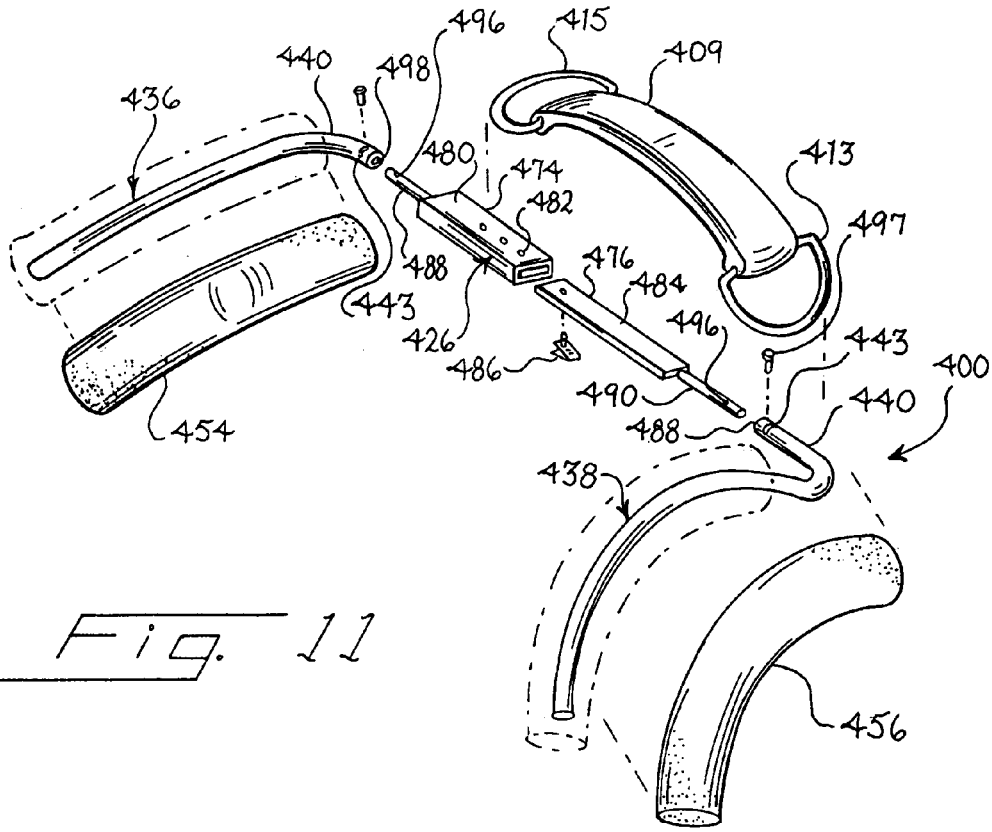
Fig. 11

Fig. 12
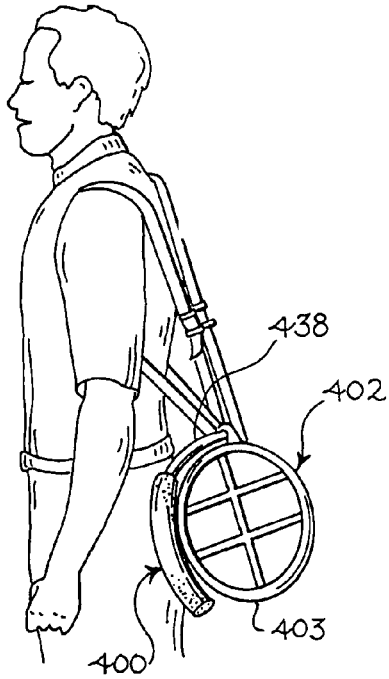
Fig. 13
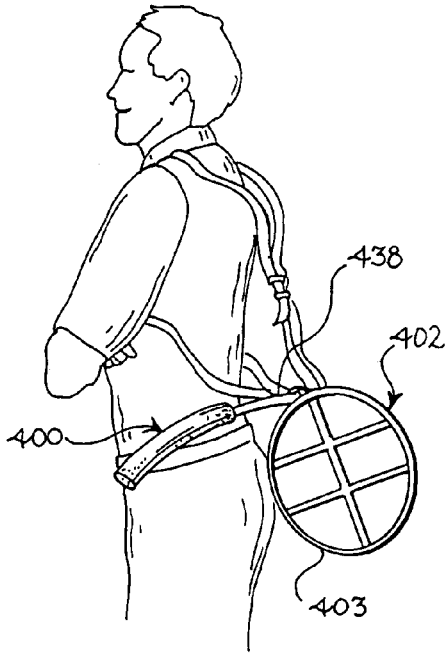
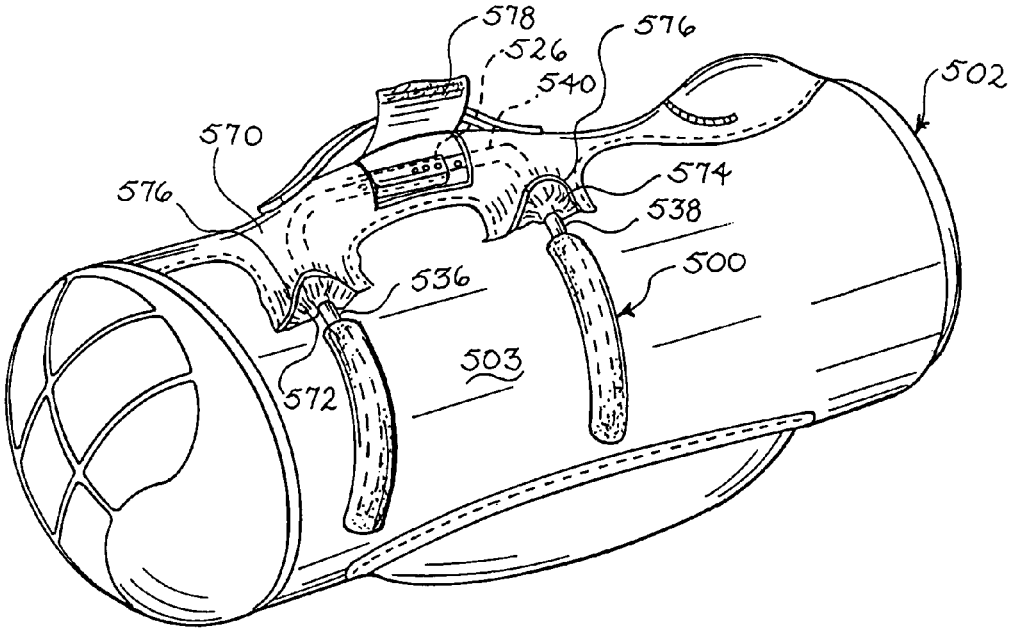
Fig. 14

RIGID HIP SUPPORT MEMBER FOR PACKS, BAGS AND OTHER ARTICLES

FIELD OF THE INVENTION

This invention relates to a rigid hip support member for packs, bags and other articles adapted to be mounted or suspended from the back or shoulders of a wearer.

BACKGROUND OF THE INVENTION

Packs, bags and articles which are mounted to the back of a wearer such as, for example, school back packs, hiking back packs, and golf bags have been in widespread use for many years. Although these articles have proven effective in allowing wearers to carry and support books, hiking supplies and golf clubs, they disadvantageously have placed wearers at an increased risk of shoulder and back injury due to the considerable weight which is often times carried in these articles. This risk has become a particular concern for grade school children who are increasingly being forced to carry excessive numbers of books and supplies in their back packs in order to keep up with the ever escalating homework requirements. This risk is also a concern for caddies who must carry golf bags weighing more than fifty pounds for more than 7,000 yards during a four hour round of play.

In the past, adjustable flexible belts or harnesses have been used in an attempt to relieve the weight of the pack, bag or other article. These belts and harnesses, however, have been ineffective as a weight transferring device and there thus remains a need for a hip support member which will effectively transfer the weight from the shoulders and back of the wearer to the hips and lower back of the wearer.

SUMMARY OF THE INVENTION

The invention relates to a member for supporting an article about the hips of a wearer of the article where the member comprises a frame defined by a pair of spaced-apart rigid arms adapted to cooperate with the article and engage In one embodiment where the article is a back pack including opposed side faces and an open sleeve extending along a lower edge of each of the side faces, the arms are adapted to be slid and extended into the sleeves respectively. In another embodiment where the article is a back pack including a back face and a sleeve associated therewith, the arms are adapted to be extended through the sleeve and secure the arms to the article. The arms may be adapted for rotation about the sleeve and the article between a disengaged position and an engaged position against the hips of the wearer.

A sleeve integral with the arms may extend between the arms to define a generally U-shaped frame adapted to be secured to the article. The sleeve may comprise a pair of cooperating elements adapted to allow the distance between the arms to be adjusted. Each of the arms may also include an extended shoulder which cooperate together to secure the arms together. Each of the shoulders may be a hollow tube and the shoulders may telescope together.

In the embodiment where the arms are connected to a sleeve and the article is a golf bag including a spine, the member is adapted to be mounted to the golf bag in a relationship where the sleeve is disposed generally co-planarly with the spine. The arms may be adapted to be secured directly to the spine of the golf bag and the arms may be rotatable and slidable about the spine. Alternatively, the arms may be secured to a bracket adapted to be removably secured to the handle of the golf bag.

Other advantages and features of the present invention will be more readily apparent from the following detailed description of the preferred embodiments of the invention, the accompanying drawings, and the appended claims.

BRIEF DESCRIPTION OF THE DRAWINGS

In the drawings:

FIG. 10 is a side perspective view of a golf bag incorporating a hip support member of the present invention;

FIG. 11 is an exploded perspective view of the hip support member of FIG. 10;

FIG. 12 is a side elevational view of the golf bag of FIG. 10 suspended from the back and shoulders of a wearer with the hip support member in its disengaged position;

FIG. 13 is a side elevational view of the golf bag of FIG. 10 with the arms of the hip support member in their engaged position around the hips of the wearer;

FIG. 14 is a perspective view, partly in phantom, of a golf bag incorporating an alternate embodiment of the hip support member of the present invention;

DETAILED DESCRIPTION OF THE PREFERRED EMBODIMENTS

Figure 1:
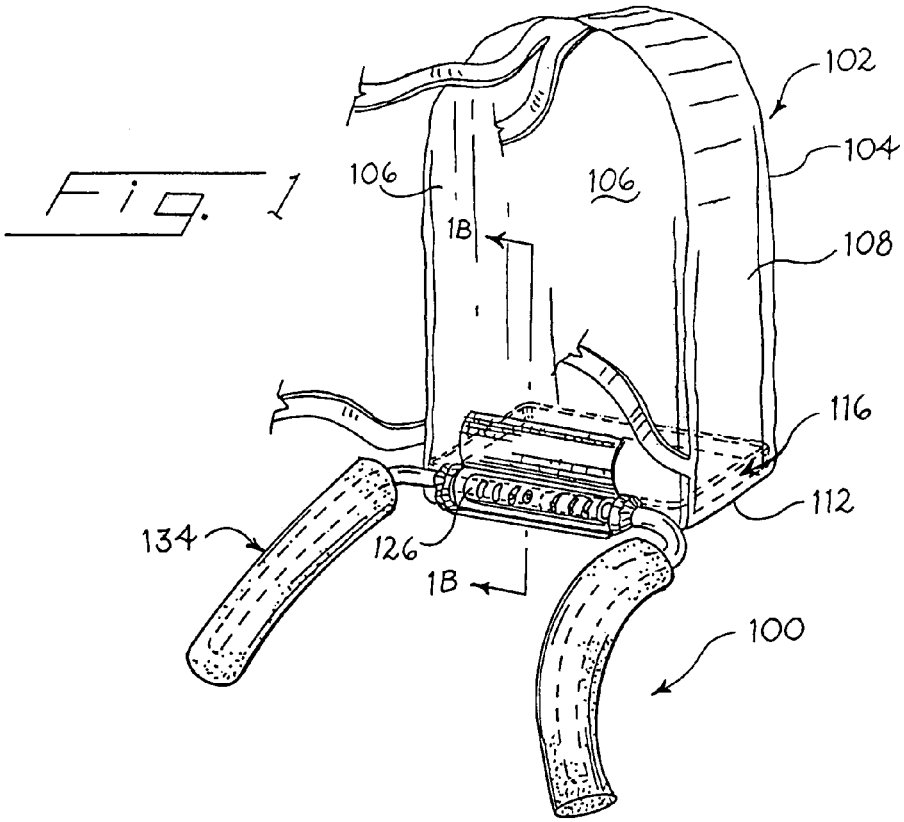
FIG. 1 is a perspective view, partially broken away, of a back pack incorporating a hip support member of the present invention.

The invention disclosed herein is, of course, susceptible of embodiment in many different forms. Shown in the drawings and described herein below in detail are preferred embodiments of the invention. It is to be understood, however, that the present disclosure is an exemplification of the principles of the invention and does not limit the invention to the illustrated embodiments.

For ease of description, the hip support member and the various bags incorporating the hip support member of the present invention will be described in a normal (upright) operating position and terms such as upper, lower, horizontal, etc., will be used with reference to this position. It will be understood, however, that the hip support member and bags of the present invention may be manufactured, stored, transported, used, and sold in an orientation other than the positions shown and described herein.

FIGS. 1, 1A, 11B and 2 depict a hip a support member 100 which, in the embodiment shown, is adapted for use with any type of shoulder or back mounted bag or pack such as, for example, the back pack 102 shown in FIG. 1 which includes front and back faces 104 and 106 respectively, opposed side faces 108 and 110 respectively and a bottom face 112 which has a sheet of cardboard or the like floor material 114 seated thereon and adapted to provide support for the contents of the pack 102.

Figures 1A, 1B, 2:
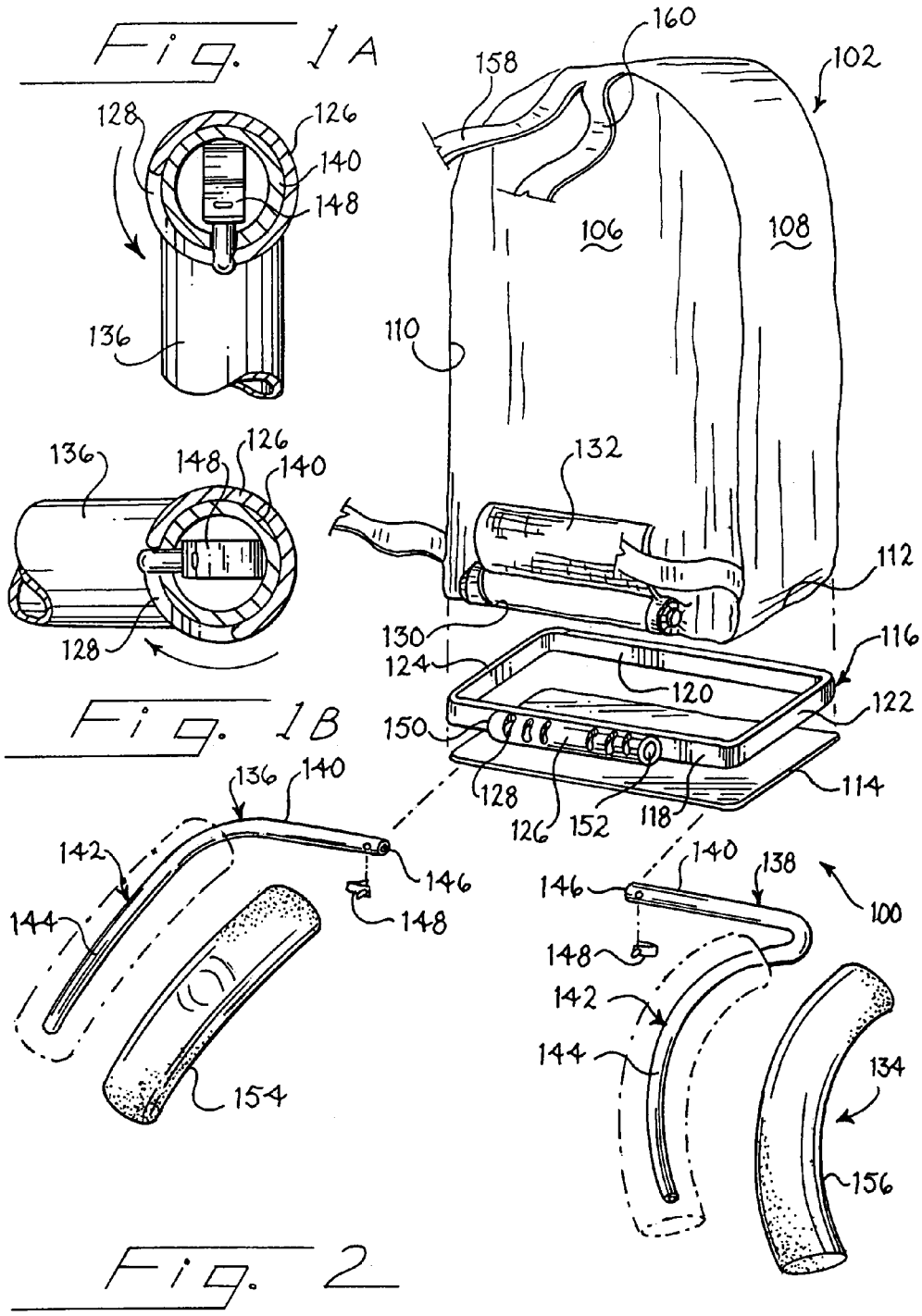
FIG. 1A is an exploded, vertical cross-sectional view, partly broken away, depicting the relationship between the arms and the sleeve in the disengaged position of the hip support member of the present invention.
FIG. 1B is an exploded, vertical cross-sectional view, partly broken away, depicting the relationship between the arms and the sleeve in the engaged position of the hip support member of the present invention.
FIG. 2 is an exploded perspective view, partly broken away, of the back pack of FIG. 1.

In the embodiment as shown in FIGS. 1 and 2, the hip support member 100 initially comprises a generally rectangular back pack frame 116 which is made of any suitable rigid material such as aluminum, steel, plastic, or the like and is adapted to be seated in the interior of the pack 102 against the bottom sheet 114. Pack frame 116 is defined by opposed front and back flat vertical ribs 118 and 120 respectively and opposed flat side vertical ribs 122 and 124 disposed in adjacent or abutting relationship with the interior surfaces of the back and front faces 106 and 104 and the side faces 108 and 110 of the pack 102 respectively.

An elongate hollow tube, rod or sleeve 126, which is made of the same type of material as frame 116, is secured to and extends longitudinally along the outer vertical face of the front rib 118 thereof. Alternatively, the sleeve 126 could be secured directly to the back face 106 of the pack by any one of several known methods. Sleeve 126 includes and defines a plurality of elongate slots 128 extending between the outer and inner surfaces thereof. In the embodiment shown, the sleeve 126 includes two spaced-apart sets of three slots each, the slots 128 in each of the sets being aligned in spaced-apart and co-linear relationship and extending partially around the circumference of the sleeve 126. In accordance with the present invention, the sleeve 126 is adapted to protrude through an appropriately sized aperture or opening 130 formed in the back face 106 of the pack 102. A flap 132 or the like is stitched or otherwise suitably secured to the back face 106 of the pack 102 and is adapted to cover the sleeve 126.

The hip support member 100 still further comprises a generally "U"-shaped hip frame 134 which, in the embodiment shown, is made of aluminum, steel, plastic, composite or the like suitable rigid tubular material. Hip frame 134 comprises a pair of generally "L" shaped elongate shafts or tubes defining spaced-apart arms 136 and 138. Each of the arms 136 and 138 includes an elongate extended shoulder 140 and a unitary, elongate distal hip engaging segment or portion 142 extending generally normally outwardly from the shoulder 140. The hip engaging portion 142 incorporates an inwardly bent, curved or arcuate central segment 144. The free end 146 of the extended shoulder 140 of each of the arms incorporates a depressable spring-activated pin, button or the like element 148 adapted to allow the arms 136 and 138 to be removably and rotatably secured inside the ends of the sleeve 126 as described in more detail below.

Preferably, the arms 136 and 138 are mirror images of each other and are disposed generally co-planarly to each other in both the disengaged and engaged positions of the hip support member 100. Moreover, each of the arms 136 and 138 bend not only inwardly in the direction of the distal ends thereof away from the shoulders thereof but also downwardly in the same direction.

In accordance with the present invention, each of the arms 136 and 138 have an outside diameter which is slightly less than the inner diameter of the sleeve 126 to allow the free end 146 of each of the extended shoulders 140 respectively to be advanced into and through the open ends 150 and 152 respectively of the sleeve 126. The arms 136 and 138 are advanced into the hollow sleeve 126 until the respective pins 148 are locked into one of the selected slots 128 thereby locking and securing the arms 136 and 138 to the sleeve 126. As shown in FIGS. 1A and 1B, the slots 128 in combination with the pins 148 not only secure the arms 136 and 138 to the rod 126 but also are sized to allow the arms 136 and 138 to rotate about the sleeve 126 between the position of FIG. 1A and the position in FIG. 1B where the arms have been rotated approximately ninety degrees in the clock-wise direction.

The hip support member 100 still further comprises a pair of elongate hollow generally cylindrical comfort pads or cushions 154 and 156 adapted to be slid over the respective hip engaging portions 142 of the arms 136 and 138 respectively. The pads or cushions 154 and 156 may be made of any suitable soft, pliable and/or deformable material. Alternatively, a suitable layer of cushioning material may be applied directly to the surface of the arms by any know process. In the engaged position of FIG. 1, the arms 136 and 138 are disposed generally horizontally co-planarly with the bottom face 112 of the pack 102 and serve as a stand which allows the pack 102 to be seated in an upright position on a support surface.

Figure 3:
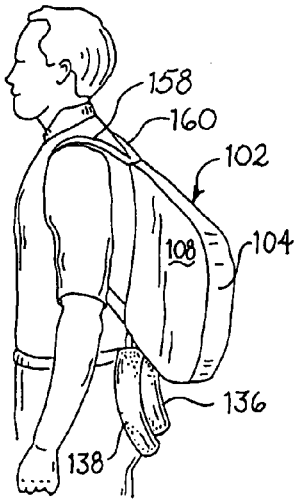
FIG. 3 is a side elevational view of the back pack of FIG. 1 suspended from the shoulders of a wearer with the hip support member in its disengaged position.
Figure 4A:
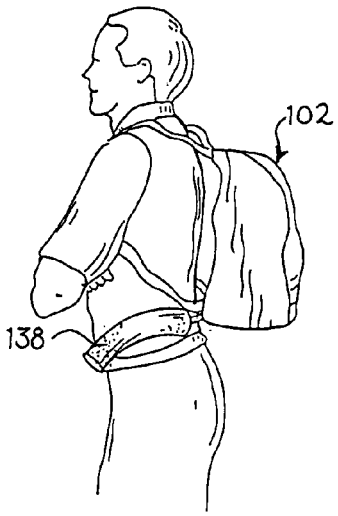
FIG. 4A is a side elevational view of the back pack of FIG. 1 suspended from the shoulders of the wearer with the arms of the hip support member in their engaged position around the hips of the wearer.
Figure 4B:
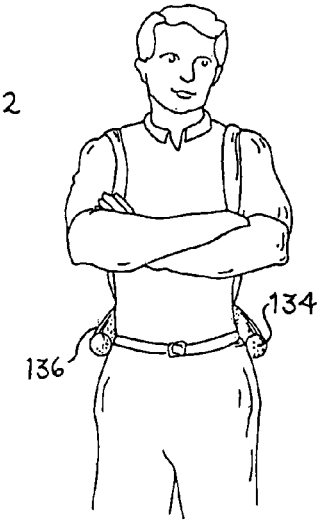
FIG. 4B is a front elevational view of the back pack of FIG. 1 suspended from the shoulders of the wearer with the arms of the hip support member in their engaged position around the hips of the wearer.

As shown in FIGS. 3, 4A and 4B, the back pack 102 is adapted to be mounted to the back of a wearer and suspended from the shoulders of the wearer by means of shoulder straps 158 and 160 associated with the pack 102.

The hip support member 100 is adapted to be used or oriented in a first disengaged position (FIG. 3) where the arms 136 and 138 are disposed in a generally, up and down vertical position generally vertically co-planarly with the back face 104 of the pack 102 against the back and buttocks of the wearer. In a second position as shown in FIGS. 4A and 4B, the arms 136 and 138 have been rotated about ninety degrees in the clock-wise direction about the sleeve 126 and the pack 102 (i.e., from the position of FIG. 1A to the position of FIG. 1B) to allow the arms 136 and 138 to wrap and engage against the hips of the wearer. In this position, the arms are disposed generally horizontally co-planarly with the bottom face 112 of the pack 102.

In accordance with the present invention, the arms 136 and 138 and, more particularly, the arcuate segments 144 of the hip engaging portions 142 thereof, exert a force against the hips which causes a portion of the weight of the pack 102 and the contents thereof to be transferred away from the shoulders and back of the wearer successively through the pack 102, the pack frame 116, the sleeve 126, the arms 136 and 138, and to the hips of the wearer thus advantageously reducing the shoulder and upper back stresses which often times lead to shoulder and back injuries. According to the invention, a majority of the weight of the back pack 102 and its contents is thus advantageously reconcentrated and redistributed through the hip support member 100 from the shoulders and upper back of the wearer to the hips and lower back of the wearer.

The width of the hip frame 134 of the member 100 can be adjusted to accommodate differently sized hips by adjusting the width between the arms 136 and 138 which, of course, is accomplished by sliding one or both of the extended shoulders 140 of the arms 136 and 138 into locking relationship into whichever of the selected slots 128 on the sleeve 126 provide the wearer with the desired width and engaging fit.

Figure 5A:
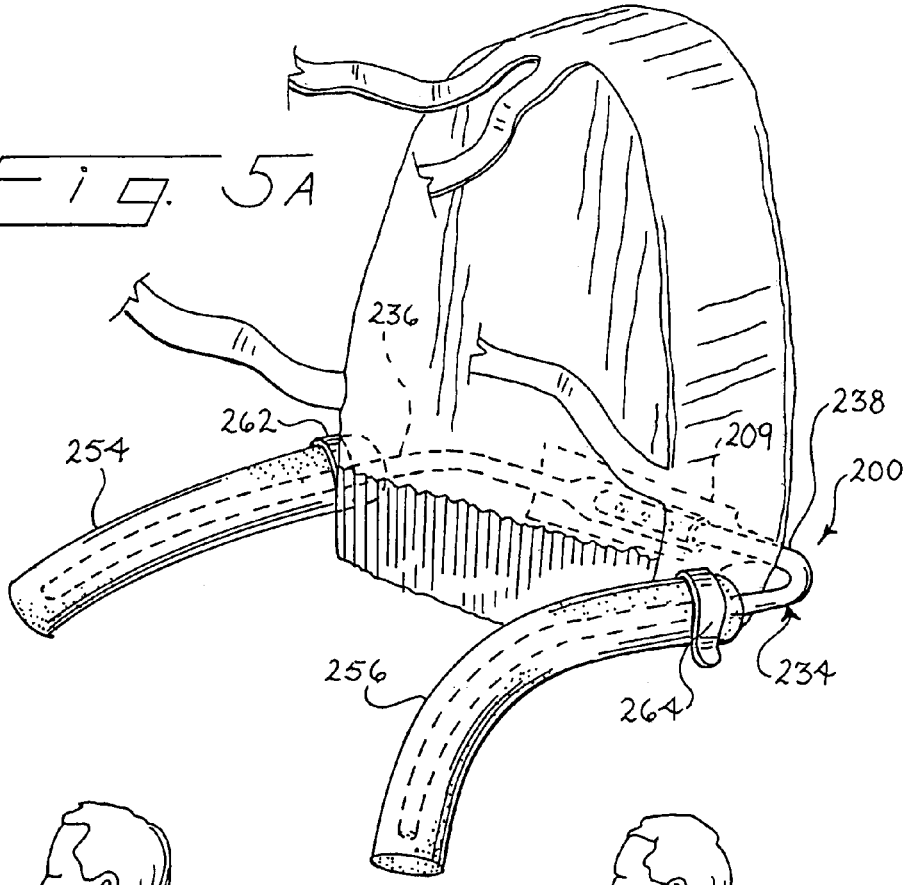
FIG. 5A is a perspective view, partially in phantom and broken away, of a back pack incorporating another embodiment of the hip support member of the present invention.
Figure 5B:
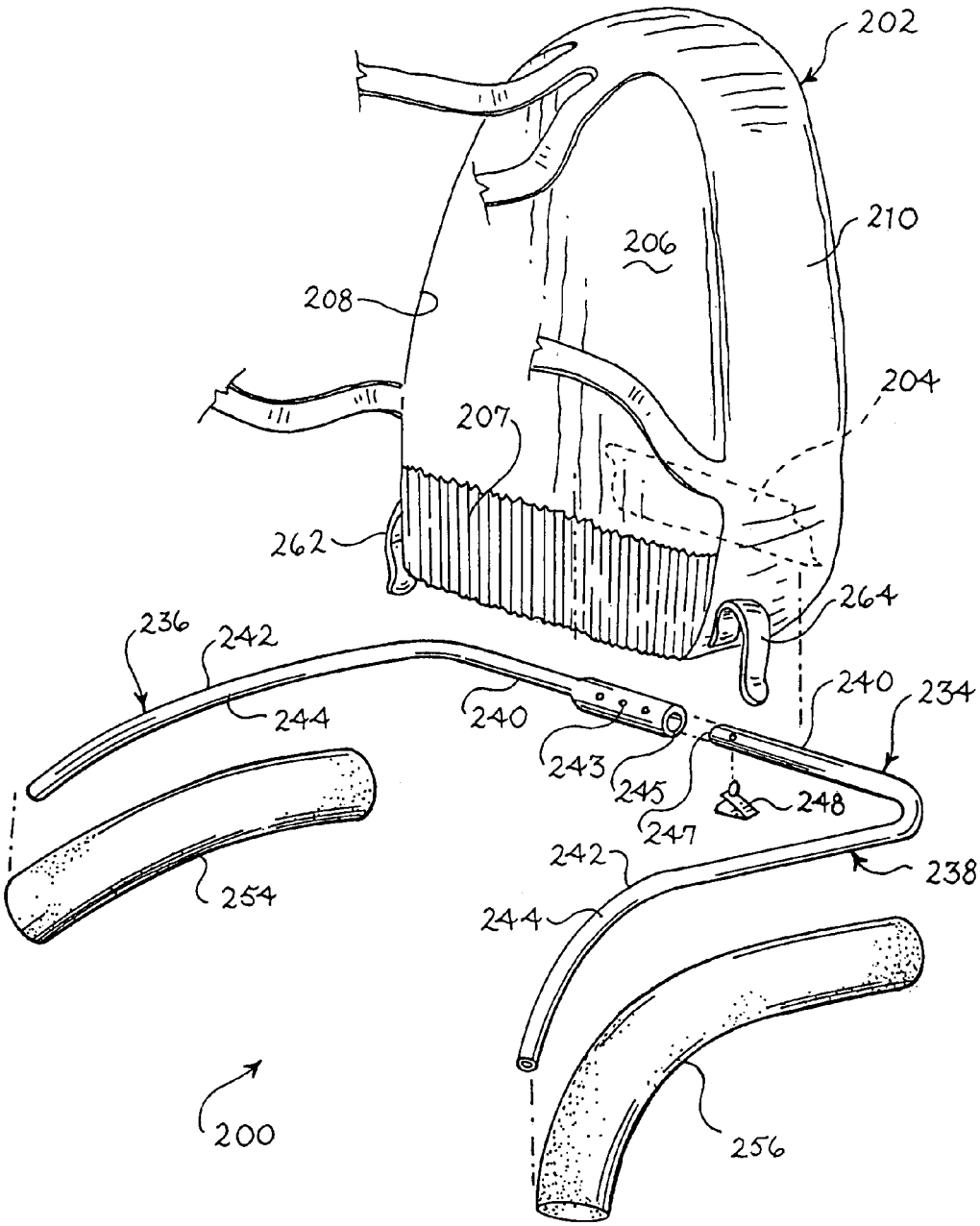
FIG. 5B is an exploded perspective view of the hip support member of FIG. 5A.

FIGS. 5A and 5B depict another embodiment of a hip support member 200 including a generally U-shaped hip frame 234 comprising two inter connected and telescoping generally "L" shaped tubes or shafts defining spaced-apart generally co-planar arms 236 and 238 which are preferably made of the same type of material as the arms of the hip support member 100 shown in FIG. 1. Particularly, each of the arms 236 and 238 of the hip support member 200 includes a hip engaging support portion 242 and a proximal extended and elongate shoulder 240 which extends unitarily generally normally inwardly from the proximal end of the hip engaging portion 242. The hip engaging portion 242 of each of the arms 236 and 238 incorporates an inwardly bent curved or arcuate central segment 244 between the proximal and distal ends thereof. The arms 236 and 238 are also mirror images of each other and are disposed in a spaced-apart relationship generally co-planarly to each other in both the disengaged and engaged positions of the member 200. The arms 236 and 238 additionally arc or curve downwardly in the direction of the distal ends thereof. In accordance with the present invention, the extended shoulder 240 of the arm 236 includes and defines a plurality of spaced-apart, co-linear longitudinally extending apertures 243 adjacent the free distal open end 245 thereof while the extended shoulder 240 of the arm 238 includes a depressable pin, button or the like element 248 similar to the pin 148 described above with respect to the hip support member 100.

As shown in FIGS. 5A and 5B, the distal open end 245 of the shoulder 240 of arm 236 preferably has an inner diameter which is slightly greater than the outer diameter of the distal free end 247 of the shoulder 240 of arm 238 to allow the free end 247 of the shoulder 240 of the arm 238 to be telescoped or fitted into the free end 245 of the shoulder 240 of the arm 236. Shoulder 240 of arm 238 is advanced into the shoulder 240 of arm 236 and the pin 248 is locked into the appropriate selected aperture 243 depending, of course, upon the desired and preferred width of the hip frame 234.

The back face 206 of the pack 202 incorporates a strip of elastic or the like material 207 extending along a lower longitudinal portion thereof between the side faces 208 and 210 thereof to allow the arms 236 and 238 to be moved laterally towards or away from the pack 202 as described in more detail below. In the embodiment of FIGS. 5A and 5B, the respective arms and, more particularly, the shoulders 240 thereof are adapted to extend through a hollow sleeve or jacket 209 which is preferably made of the same type of material as the pack 202 and has been stitched, sewn, or otherwise suitably secured to a lower longitudinal portion of the front face 204 of the pack 202. The sleeve 209 incorporates a flap 211 (FIG. 6) which allows access to the respective interconnected shoulders 240 of the member 200 for adjusting the width of the arms 236 and 238 thereof.

Although not shown in any of the drawings, it is understood that, in an alternate embodiment, the sleeve 209 may extend not only across a lower portion of the front face 204 of the pack 202 but also continuously along a lower longitudinal portion of the side faces 208 and 210 of the pack 202. In this alternate embodiment, both the shoulders and the portion of the arms 236 and 238 abutting the side faces 208 and 210 respectively would be covered by the sleeve 209.

A pair of elongate hollow cylindrical pads or cushions 254 and 256, similar in structure to those described earlier in connection with the hip support member 100, are adapted to be slid over and along the respective hip engaging portions 242 of the arms 236 and 238. Moreover, in this embodiment, a pair of hooks or brackets 262 and 264 are stitched or otherwise suitably secured to a lower portion of the side faces 208 and 210 of the pack 202 adjacent the front face 204 thereof for engaging the arms 236 and 238 as described in more detail below.

Figure 6:
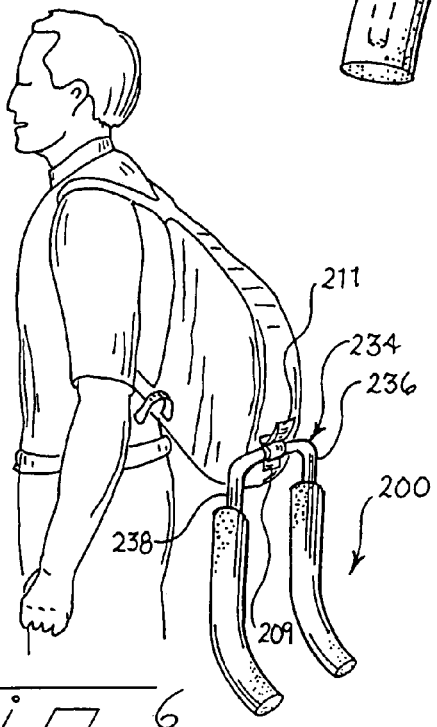
FIG. 6 is a side elevational view of the back pack of FIG. 5A suspended from the shoulders of a wearer with the hip support member in its disengaged position.
Figure 7:
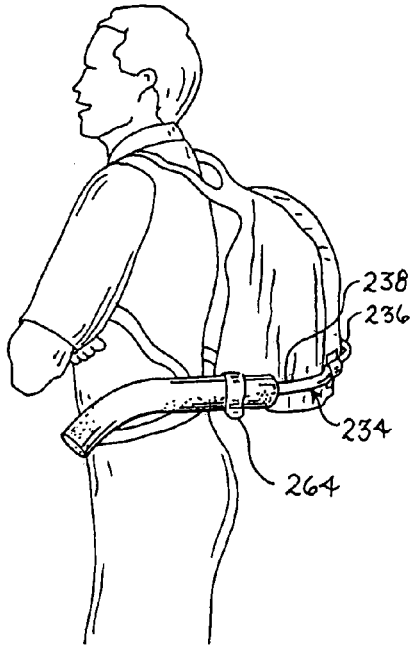
FIG. 7 is a side elevational view of the back pack of FIG. 5A with the arms of the hip support member in their engaged position around the hips of the wearer.

In use, the hip support member 200 is rotatable about the sleeve 209 and the pack 202 between the disengaged position of FIG. 6 where the arms thereof are positioned in a generally up and down vertical co-planar relationship spaced from the wearer into the position of FIG. 7 where the arms have been rotated clock-wise approximately ninety degrees and wrapped into abutting and engaging position against the hips of the wearer. In the position of FIG. 7, the brackets 262 and 264 encircle the arms 236 and 238 and limit any further clock-wise movement of the arms 236 and 238 relative to the pack 202 beyond the initial ninety degrees. The brackets 236 and 238 additionally provide support for the pack 202 and, as shown in FIG. 7, eliminate the sagging of the bottom of the pack 202. In the engaged positions of FIGS. 5A and 7, a portion of the respective hip engaging portions 242 of the arm 236 and 238 extend and abut against a lower longitudinal portion of the side faces 208 and 210 respectively of the pack 202 between the front and back faces 204 and 206 respectively.

As described above with respect to the hip support member 100, the hip support member 200 also allows a transfer of the weight of the contents of the pack 202 away from the shoulders and the upper back of the wearer to the hips and lower back of the wearer through the respective shoulders 240 and then through the respective hip engaging portions 242 of the arms 236 and 238 of the member 200.

Although not shown in any of the FIGURES, it is understood that the hip support member 200 could likewise be suspended and rotatable about a sleeve or jacket, similar to the sleeve 209, which is stitched, sewn or otherwise suitably secured to a longitudinal lower portion of the back face 206 of the pack 202.

Figure 8:
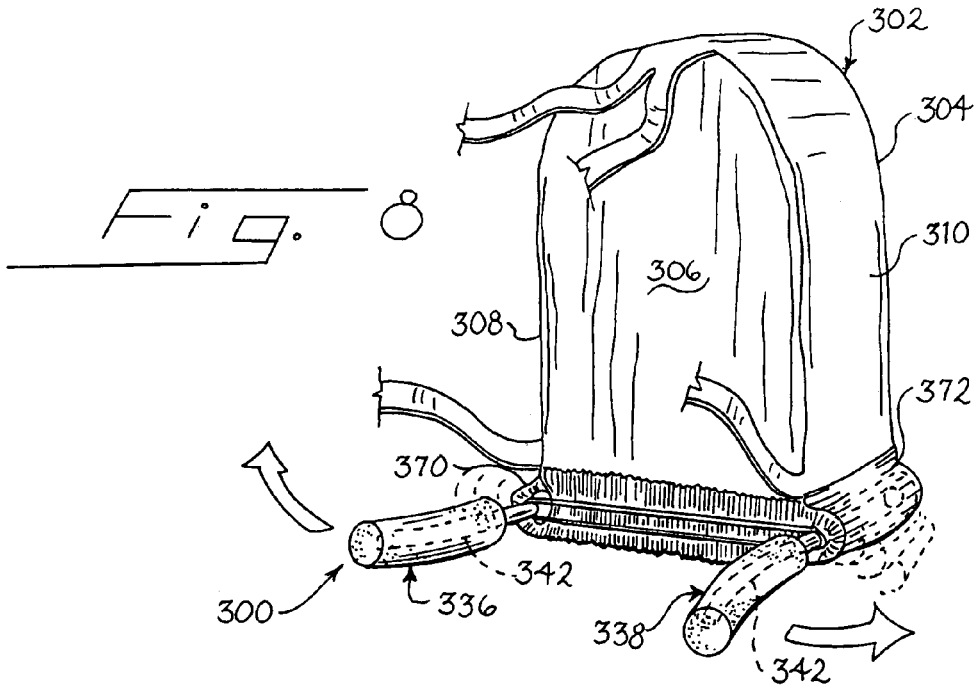
FIG. 8 is a perspective view, partly in phantom and broken away, of a back pack incorporating another embodiment of the hip support member of the present invention.
Figure 9:
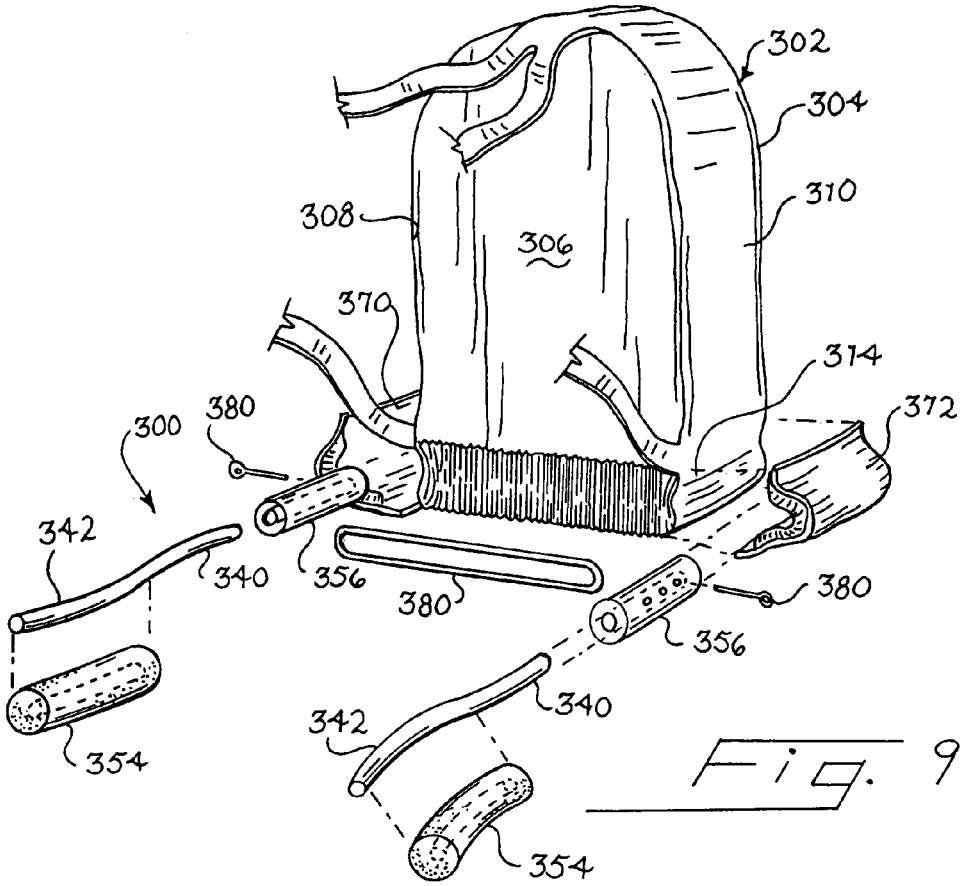
FIG. 9 is an exploded perspective view of the back pack of FIG. 8.

FIGS. 8 and 9 depict yet a further hip support member embodiment 300 which includes a pair of elongate spaced-apart and generally co-planar arms 336 and 338 adapted to be slid generally longitudinally inwardly into respective elongate longitudinally extending hollow sleeves or jackets 370 and 372 which are made of a suitable elastic or the like material, and have been stitched, sewn or otherwise suitably secured to a lower longitudinal portion of the side faces 308 and 310 respectively of the pack 302. Sleeves 370 and 372 extend longitudinally generally between the front and back faces 304 and 306 of the pack 302 adjacent the bottom or floor face 314 thereof. Each of the arms 336 and 338 includes a proximal elongate sleeve portion 340 and a distal unitary hip engaging portion 342.

The arms 336 and 338 are slid or extended generally horizontally into the sleeves 370 and 372 respectively until the distal end of the respective sleeve portions 340 thereof are abutted against the closed rear end (not shown) of each of the sleeves 370 and 372. The hip engaging portion 342 of each of the arms 336 and 338 protrudes outwardly from the sleeves 370 and 372 and generally normally outwardly from a lower portion of the back face 306 of the pack 302. Each of the arms 336 and 338 is adapted to be surrounded by a pair of elongate cushions 354 and 356. Cushion 354 is adapted to cover the hip engaging portion 340 of the arms 336 and 338 while cushion 356 is adapted to surround the sleeve portion 340 of each of the arms 336 and 338 and allows the arms 336 and 338 to be removably secured in the respective sleeves 370 and 372.

A pin 380 extends through the cushions 356 and into the sleeve portion 340 of each of the arms 336 and 338 for securing the respective cushions 356 to the arms and to inwardly secure the arms inside the sleeves 370 and 372.

Although not shown in any of the FIGURES, it is understood that the generally horizontally co-planarly aligned and spaced arms 336 and 338 of the hip support member 300 are adapted to engage against the hips of a wearer of the pack 302 in a manner similar to that described in connection with the earlier described hip support member embodiments. As such, the arms 336 and 338 allow the transfer of the weight of the pack 302 from the shoulders and upper back of the wearer downwardly towards the bottom of the pack 302, then through the arms 336 and 338 respectively and then to the hips of the wearer. The elasticity or stretchability of the material comprising the sleeves 370 and 372 allows the arms 336 and 338 to be flexed outwardly away from the side faces of the pack 302 to accommodate the waist or hip sizes of a variety of wearers. An elastic band 380 is adapted to surround the arms 336 and 338 in the area of the sleeve portions thereof so as to cause the arms to exert a force against the hips as desired.

Figure 18:
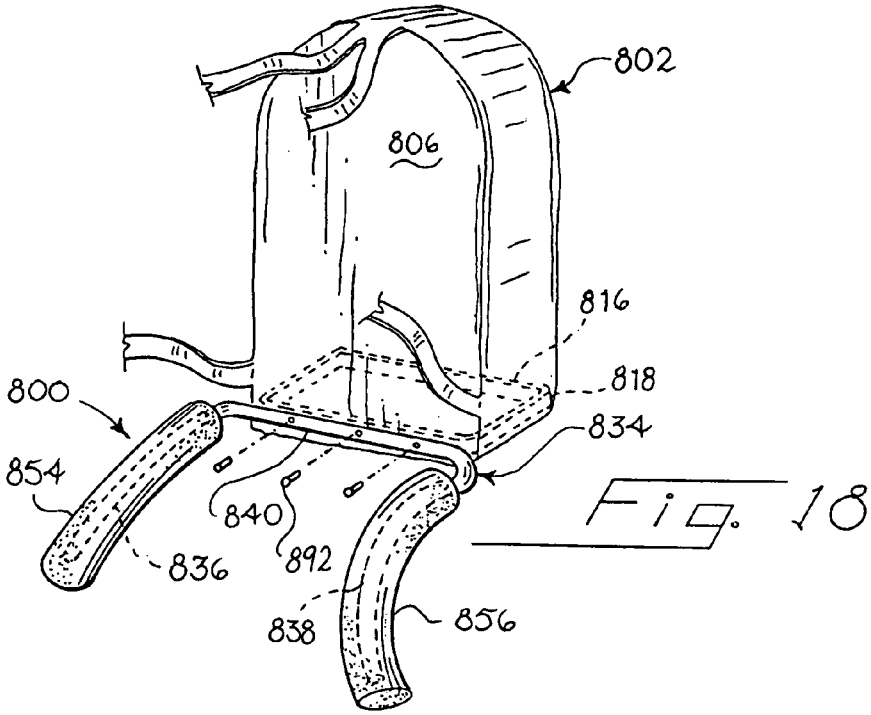
FIG. 18 is a perspective view, partially broken away and exploded, of still a further embodiment of the hip support member of the present invention.

It is understood that FIGS. 1–9 depict only three hip support member embodiments suitable for use with a back pack and that the invention encompasses all other suitable embodiments which fall within the scope of the invention including, but not limited to, the hip support member embodiment 800 of FIG. 18 which is similar in structure to the hip support member 100 except that it includes a unitary, non-adjustable and non-rotatable U-shaped tubular hip frame 834 incorporating a pair of spaced-apart generally horizontally co-planarly oriented elongate shafts defining arms 836 and 838 and a longitudinal sleeve 840 therebetween and unitary with the proximal ends of the arms 836 and 838. Sleeve 840 is generally horizontally co-planarly oriented with the arms 836 and 838 and is adapted to mounted or otherwise secured directly to a lower longitudinal portion of the back face 806 of the back pack 802 using any suitable means including, for example, Velcro®, snaps, sleeves, jackets or the like. In the embodiment of FIG. 18, rivets 892 extend through the sleeve 840, the material or fabric comprising the back face 806 of the back pack 802 and into the front rib 818 of frame 816 located in the interior of the back pack 802. In this embodiment, the arms 836 and 838 are permanently extended generally outwardly away from the pack or article intended to be supported by the hip support member. Elongate cushions 854 and 856 cover the arms 836 and 838 respectively.

Another hip support member embodiment 400 is shown in FIGS. 10–13 which is adapted to be integrated for use on a golf bag 402.

As with the other hip support member embodiments, the hip support member 400 comprises a generally "U" shaped frame 434 including a pair of elongate shafts or tubes defining spaced-apart generally co-planarly aligned arms 436 and 438 terminating in elongate inwardly extending shoulders 440 generally co-planarly aligned with the arms. A central sleeve 426 interconnects the two generally "L" shaped arms 436 and 438 together about the shoulder 440 thereof to define the frame 434. Each of the arms 436 and 438 comprises an elongate, rigid and preferably hollow tube or rod which has been shaped and configured to follow the contour of the outer surface 403 of the golf bag 402. Elongate, hollow cylindrical cushions or pads 454 and 456, similar in structure and function to those described earlier in connection with the earlier hip support embodiments, are adapted to slide over and cover all or a portion of the arms 436 and 438 respectively. The open, hollow distal end 498 of the extended shoulder 440 of each of the arms 436 and 438 includes an elongate slot 443 extending around a portion of the circumference thereof.

The sleeve 426 comprises first and second hollow flat bars 474 and 476. Bar 474 is sized to fit or telescope into an open end 478 of bar 476. Each of the bars 474 and 476 has a plurality of flat circumferential outer surfaces. Particularly, bar 474 includes a flat lower surface (not shown) and a flat top surface 480 having a plurality of apertures 482 extending therethrough and aligned in space-apart and co-linear relationship thereon. Bar 476 includes a flat lower surface (not shown) and a flat top surface 484 incorporating a depressable push button, pin or the like element 486 adapted to snap into engagement with a selected one of the apertures 482 in the bar 474 for locking the two bars 474 and 476 of the sleeve 426 together.

Elongate shafts 488 and 490 extend longitudinally outwardly from closed ends of the bars 474 and 476 respectively opposite the ends of the bars which are telescoped together. Each of the shafts 488 and 490 defines a threaded aperture 496 extending partially therethrough and adapted to receive a threaded screw 497. In accordance with the invention, the shafts 488 and 490 are adapted to receive the open distal end 498 of the shoulder 440 of each of the arms 436 and 438 respectively into a relationship wherein the slots 443 therein are aligned with the respective apertures 496 in the shafts 488 and 490. The screws 497 are then inserted through the slots 443 and into the threaded apertures 496 to lock the arms 436 and 438 to the sleeve 426. Slots 443 allow the arms 436 and 438 respectively to rotate about the shafts 488 and 490 and are sized to allow a ninety degree rotation of the arms 436 and 438 relative to the shafts and the sleeve 426.

As shown in FIG. 10, the hip support member 400 is adapted to be seated against the outer surface 403 of the golf bag 402 in a relationship where the sleeve 426 is positioned in the transverse bag direction in a generally vertical co-planar relationship with the spine 405 and handle 409 of the bag 402 with the lower flat faces (not shown) of the bars 474 and 476 of the sleeve 440 abutted against the surface 403 of the bag 402. In the longitudinal bag direction, member 400 is positioned such that the sleeve 426 is positioned directly beneath the handle 409 of the bag 402 in a relationship where the shaft 490 and the distal end of bar 476 protrudes and extends through the top buckle 413 of the handle 409 and the shaft 488 and the distal end of the bar 474 extends and protrudes through the opposed buckle 415 of the handle 409.

As shown in FIGS. 12 and 13, the hip support member 400 is rotatable about the spine 405 and outer surface 403 of the bag 402 between a first position (FIG. 12) where the arms 436 and 438 extend downwardly away from the spine 405 and are seated generally against the outer surface 403 of the bag and a second position (FIG. 13) where the arms 436 and 438 have been rotated approximately ninety degrees in the clock-wise direction into a tangent, outward position relative to the outer surface 403 of the bag 402 and the arms 436 and 438 surround and engage the hips of the wearer.

The use of flat bars 474 and 476 seated against the generally flat golf bag surface 403 prevents the hip support member 400 from rotating about the bag 402 more than the required ninety degrees when the arms 436 and 438 are rotated between the FIGS. 12 and 13 positions.

In a manner similar to that described earlier in connection with the back pack embodiments, the hip support member 400 advantageously transfers the weight of the bag and the clubs housed therein away from the shoulders and the upper back of the wearer to the hips of the wearer through the spine 405 of the bag 402, the sleeve 426 of the member 400, and then through the arms 436 and 438. This weight transfer, of course, advantageously reduces the burden is ordinarily associated with carrying a golf bag during an average eighteen hole round of golf. The hip support member 400 offers a particular significant advantage for caddies who are commissioned or hired to carry the bags of professional golfers at tournaments and the like where the bags can end up weighing more than fifty pounds.

FIG. 14 shows an alternate golf bag embodiment 502 where the sleeve 526 and extended elongate shoulders 540 of the arms 536 and 538 of the hip support member 500, which is similar in structure to hip support member 400, have been encapsulated or covered by a jacket or sleeve 570 which has been stitched or otherwise suitably secured over the outer surface 503 of the bag 502 in the region of the spine 505. The arms 536 and 538 protrude through a pair of spaced-apart openings 572 and 574 defined in the jacket 570. Preferably, the jacket material surrounding the openings 572 and 574 incorporates an elastic rim 576 which allows the jacket material to stretch in response to the rotation of the arms 536 and 538 from the FIG. 12 position into the FIG. 13 position. A flap 578 on the jacket 570 allows access to the sleeve 526 of hip support member 500 for adjusting the width or distance between the arms 536 and 538.

Figure 15:
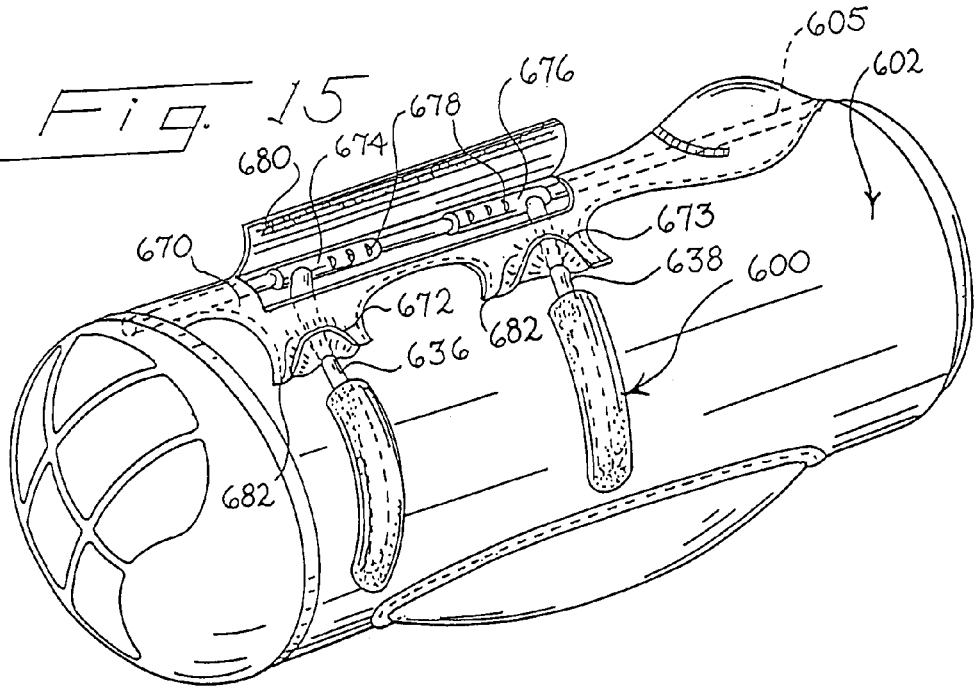
FIG. 15 is a perspective view, partly in phantom, of yet another embodiment of the hip support member of the present invention adapted to be secured directly to the spine of a golf bag.

FIG. 15 depicts yet another hip support member embodiment 600 adapted to be mounted directly to the elongate shaft or center spine 605 of the golf bag 602. The arms 636 and 638 of the hip support member 600 are similar in structure, slope and orientation to the arms 436 and 438 of the hip support member 400 of FIGS. 10 and 11. However, instead of incorporating telescoping shoulder portions, the arms 636 and 638 have respective hollow tubular shafts, shoulders or collars 674 and 676 extending unitarily generally normally inwardly from the distal ends of the arms 636 and 638 respectively. Each of the hollow shafts 674 and 676 includes a plurality of spaced-apart, co-linear longitudinally extending slots 678 defined therein. Each of the slots 678 defines an opening extending partially around the circumference of the shafts 674 and 676. The shafts 674 and 676 are adapted to be slid directly onto and surrounding the spine 605 during the manufacture of the bag 602.

Although not shown in FIG. 15, it is understood that the spine 605 has a pair of depressable push buttons or pins associated therewith, similar in structure to the buttons or pins described in connection with some of the earlier hip support member embodiments, adapted to respectively cooperate and engage with selected ones of the slots 678 in the shafts 674 and 676 for locking the arms 636 and 638 on the spine 605. As described in connection with selected ones of the earlier hip support member embodiments, the slots 678 allow the arms 636 and 638 to be rotated in a clock-wise direction approximately ninety degrees about the spine 605 and the outer surface of the bag 602 between the two positions shown in FIGS. 12 and 13. Additionally, the arms 636 and 638 are slidable along the spine 605 for adjusting the distance between the arms as desired.

A jacket or sleeve 670 similar in structure to the jacket 570 of the hip support embodiment of FIG. 14 covers the spine 605 and a portion of the arms 636 and 638. A flap 680 unitary with the jacket 670 allows access to the shafts of the arms and the spine to allow the adjustment of the width of the arms 636 and 638. Preferably, the jacket material surrounding openings 672 and 673 in the jacket 670 incorporates an elastic rim 682 which allows the jacket material to stretch when the arms are rotated about the spine.

Figure 16:
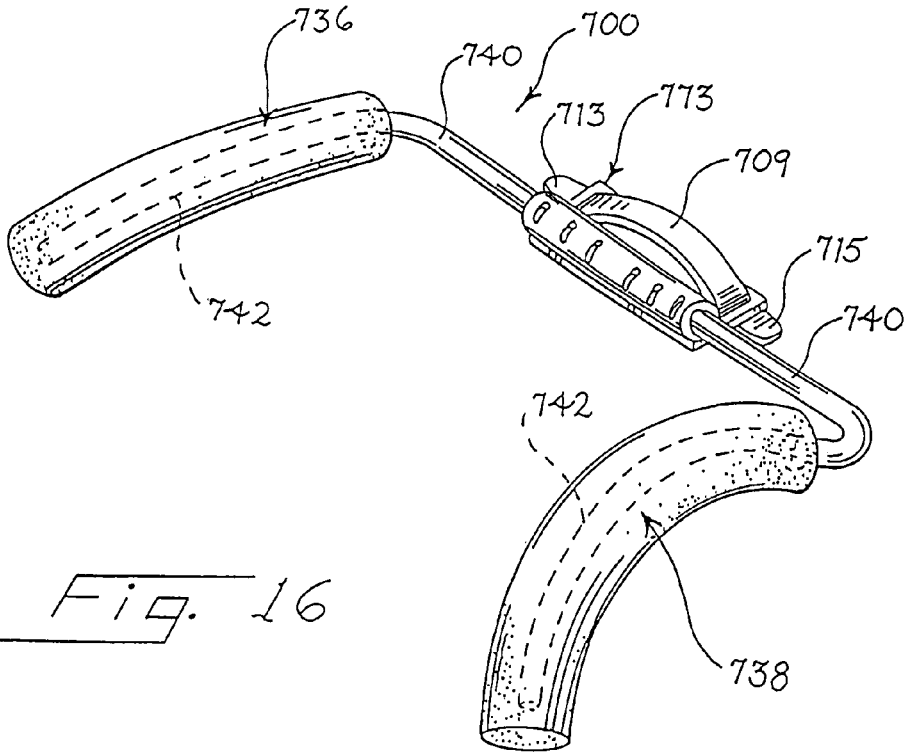
FIG. 16 is a perspective view, partly broken away, of still a further embodiment of the hip support member of the present invention adapted to be secured directly to the straps of the handle of a golf bag.
Figure 17:
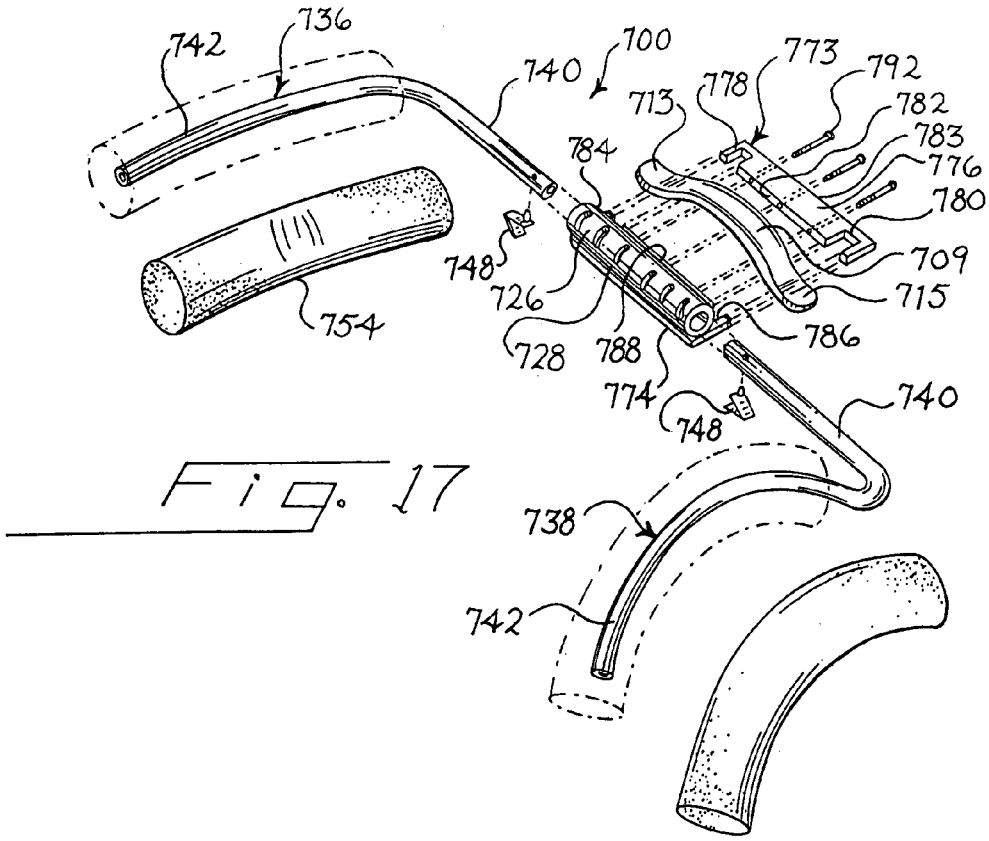
FIG. 17 is an exploded perspective view, partly broken away, of the hip support member embodiment of FIG. 16.

Yet a further embodiment of a hip support member 700 is shown in FIGS. 16 and 17. Hip support member 700 is similar in structure to hip support member 100 in that it includes arms 736 and 738 similar in structure and orientation to the arms 136 and 138 of hip support member 100. As such, each of the generally "L" shaped arms 736 and 738 includes an extended shoulder portion 740 and a unitary elongate hip engaging portion 742. However, unlike the hip support member 100, hip support member 700 incorporates a bracket 773 which allows the member 700 to be fitted and removably secured directly to the straps 713 and 715 of the handle 709 of a golf bag.

Specifically, bracket 773 comprises a pair of flat plates 774 and 776. Plate 776 defines a pair of notches 778 and 780 adjacent the ends respectively which extend inwardly into the body of the plate 776 from one of the side vertical faces 782 thereof. Plate 774 also defines a pair of spaced-apart notches 784 and 786 located adjacent the ends respectively and extending inwardly from one of the side vertical faces 788 thereof. Plate 774 additionally includes an elongate hollow mounting rod, tube or sleeve 726 seated and secured to the upper face thereof and extending generally longitudinally between the ends thereof.

Plates 774 and 776 of bracket 773 are adapted to be brought together laterally from opposite sides of the golf bag handle 709 into a relationship surrounding and secured to the handle 709 wherein the respective vertical side faces 782 and 788 and of the plates 776 and 774, respectively are abutted against each other, the upper strap portion 713 of handle 709 is received and fits inside the notches 778 and 784 defined in plates 774 and 776 respectively, and the lower strap portion 715 of handle 709 is received and fits inside the notches 780 and 786 defined in plates 774 and 776 respectively.

A plurality of screws 792 extend between the side faces 782 and 783 of the plate 776 and into the side face 788 of the plate 774 for removably securing the plates 774 and 776 and thus the sleeve 740 around the handle 709. Thereafter, the arms 736 and 738 are removably secured to the sleeve 726 in the same manner as that described earlier in connection with the FIG. 1 hip support member embodiment 100.

Slots 728 in sleeve 726 cooperate with respective depressable pins 748 associated with arms 736 and 738 for locking the arms 736 in the sleeve 726 and to allow the rotation of arms 736 and 738 relative to the sleeve 726 for the same purposes as described above in connection with the FIG. 1 embodiment. Tubular cushions 754 and 756 surround the hip engaging portions 742 of the arms 736 and 738 respectively.

It will be readily apparent from the foregoing detailed description of the invention and from the illustrations thereof that numerous variations and modifications may be effected without departing from the true spirit and scope of the novel concepts or principles of this invention. It will also be readily apparent that the hip support member of the present invention is applicable not only with back packs and golf bags but also with a variety of other articles which are adapted to be mounted to the back or suspended from the shoulders of a wearer such as, for example, back mounted vacuum cleaners, back mounted leaf blowers, and baby carriers.

I claim:

1. A member for supporting a golf bag about the hips of a user, the golf bag defining a longitudinal axis and opposed open and closed ends respectively and an outer surface therebetween defining an open interior, the golf bag further defining a spine extending through the interior of the golf bag in the same direction as the longitudinal axis and the longitudinal axis extending through the open and closed ends of the golf bag, the member including a frame defined by a sleeve and rigid arms oriented in an opposed and spaced-apart relationship and the arms being adapted to directly engage against the opposed sides of a user, the arms of the support member being further adapted for rotation about the outer surface of the golf bag between at least a first disengaged position where the arms are disposed in a hanging relationship against the outer surface of the golf bag and a second engaged position where the arms are positioned away from the outer surface of the golf bag and engaged directly against the sides of the user, the member being oriented and extending along the outer surface of the golf bag in a relationship wherein the sleeve thereof extends in the same longitudinal direction as both the longitudinal axis and the spine of the golf bag and the arms thereof extend in a direction generally normal to both the longitudinal axis and the spine of the golf bag to allow the golf bag to be carried in a generally horizontal relationship with the arms of the support member in the second engaged position against the sides of the user.

2. The member of claim 1 wherein the arms are curved and are adapted for rotation about the spine of the bag between a first disengaged position where the arms are disposed generally adjacent the golf bag and follow the contour of the golf bag and a second engaged position where the arms are positioned away from the golf bag surround and engage the hips of the user.

3. The golf bag of claim 1 wherein the arms each have respective shafts attached thereto, the shafts being secured directly to the spine of the golf bag wherein the arms are slidable and rotatable thereon.

4. The golf bag of claim 1 wherein the arms are connected to a bracket adapted to surround a handle of the golf bag.

5. The member of claim 1 wherein the golf bag has a spine and the arms of the member depend from a sleeve associated therewith and adapted to be positioned against the bag in a generally co-planar relationship with the spine of the golf bag.

6. The member of claim 5 wherein the sleeve includes first and second telescoping plates.

7. The golf bag of claim 6 wherein a shaft extends longitudinally outwardly from a distal end of each of the first and second plates respectively, the arms extending into the shafts respectively and being adapted for rotation about the shafts.

8. The member of claim 5 wherein the sleeve is adapted to be covered by a jacket integral with the golf bag, the jacket defining a pair of openings through which the arms protrude.

9. The member of claim 8 wherein the jacket includes a flap allowing access to the sleeve.

* * * * *